US006554366B2

(12) United States Patent
Zeeuw et al.

(10) Patent No.: US 6,554,366 B2
(45) Date of Patent: Apr. 29, 2003

(54) NUT PLATE RETAINER

(75) Inventors: Bryan H. Zeeuw, Lowell, MI (US); Steven K. Meek, Grand Rapids, MI (US); Joseph T. Percy, Caledonia, MI (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 09/952,794

(22) Filed: Sep. 14, 2001

(65) Prior Publication Data

US 2003/0053851 A1 Mar. 20, 2003

(51) Int. Cl.[7] ..... A47C 7/00
(52) U.S. Cl. ..... 297/440.15; 403/13; 403/22
(58) Field of Search ..... 403/12, 22, 329, 403/13, 388, 14, 299, 361, 373, 408.1; 411/366.1–366.3, 374, 396, 397, 409, 435; 297/353, 383, 440.15, 463.1, 463.2, 325

(56) References Cited

U.S. PATENT DOCUMENTS 5,068,956 A * 12/1991 Malewicz ..... 29/437
5,249,983 A * 10/1993 Hlrai ..... 439/573
5,772,479 A * 6/1998 Fleege et al. ..... 439/801
6,027,372 A * 2/2000 Lai et al. ..... 439/573
6,050,852 A * 4/2000 Wu ..... 439/607
6,126,355 A * 10/2000 Clover, Jr. ..... 403/13
6,193,533 B1 * 2/2001 Yu ..... 439/607
6,209,963 B1 * 4/2001 Gust et al. ..... 297/463.1
6,379,196 B1 * 4/2002 Greenberg et al.

* cited by examiner

*Primary Examiner*—James R. Brittain
*Assistant Examiner*—Ruth C. Rodriguez
(74) *Attorney, Agent, or Firm*—Shook, Hardy & Bacon L.L.P.

(57) ABSTRACT

A retaining plate is provided for use in the assembly of a chair to couple a J-back to a tilt mechanism. The J-back is provided with a number of mounting holes. Similarly, the tilt mechanism is provided with a number mounting holes that can be aligned with the mounting holes in the J-back. The retaining plate has a number of mounting holes disposed therethrough that are located to align with the mounting holes of the J-back and the tilt mechanism. The plate also includes a nut-retaining wall that is formed around the mounting holes and that is dimensioned to hold a threaded nut. The plate has a mechanism that is used to couple the plate to the tilt mechanism. In use, nuts may be placed within and held by the nut-retaining wall, and the plate may be coupled to the tilt mechanism so that the J-back may be coupled to the tilt mechanism by threading bolts into the nuts, the nuts being held in place by the nut-retaining walls.

12 Claims, 1 Drawing Sheet

NUT PLATE RETAINER

STATEMENT REGARDING FEDERALLY SPONSORED RESEARCH OR DEVELOPMENT

Not Applicable

CROSS REFERENCE TO RELATED APPLICATIONS

Not Applicable.

TECHNICAL FIELD

The present invention relates to a mechanism used in the manufacture of chairs. More specifically, the present invention is directed to a retainer plate for nuts that are used to connect a chair back support to a tilt mechanism for the chair.

Chairs, particularly office-type chairs, typically have both a seat and a back. The seat and back may be coupled to a chair tilt mechanism. The tilt mechanism controls the tilting of the chair seat and chair back. The seat and back may tilt together, or may tilt relative to one another. The back of the chair is connected to the tilt mechanism, as is the seat, so that, as forces are applied to the back and seat, the chair tilt mechanism allows the back and seat to move or tilt.

Typically, the chair back is coupled to the tilt mechanism using a rigid, J-shaped structure. This structure is known in the industry as a "J-back." The longer part of the "J" is coupled to the back of the chair. The shorter part of the "J" is coupled to the tilt mechanism. Presently, the J-back is bolted to the tilt mechanism using a number of bolts and nuts. In the assembly process, the act of bolting the J-back to the tilt mechanism is somewhat cumbersome and time-consuming. The reason for this, stems from the nature of aligning the nuts, bolts and clearance holes in the tilt mechanism.

Therefore, a mechanism is needed that allows an efficient and less cumbersome attachment of the J-back to the tilt mechanism.

SUMMARY OF THE INVENTION

It is an object of the present invention to provide a mechanism that allows and efficient attachment of a J-back to a tilt mechanism of a chair.

According to the present invention, the foregoing and other objects are obtained by a retaining plate for use in the assembly of a chair to couple a J-back to a tilt mechanism. The J-back is provided with a number of mounting holes. Similarly, the tilt mechanism is provided with a number mounting holes that can be aligned with the mounting holes in the J-back. The retaining plate has a number of mounting holes disposed therethrough that are located to align with the mounting holes of the J-back and the tilt mechanism. The plate also includes a nut-retaining wall that is formed around the mounting holes and that is dimensioned to hold a threaded nut. The plate has a mechanism that is used to couple the plate to the tilt mechanism. In use, nuts may be placed within and held by the nut-retaining wall, and the plate may be coupled to the tilt mechanism so that the J-back may be coupled to the tilt mechanism by threading bolts into the nuts, the nuts being held in place by the nut-retaining walls.

Additional objects, advantages, and novel features of the invention will be set forth in part in the description which follows, and in part will become apparent to those skilled in the practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

In the accompanying drawings which form a part of the specification and which are to be read in conjunction therewith and in which like reference numerals are used to indicate like parts in the various views.

DETAILED DESCRIPTION

Figure 1:
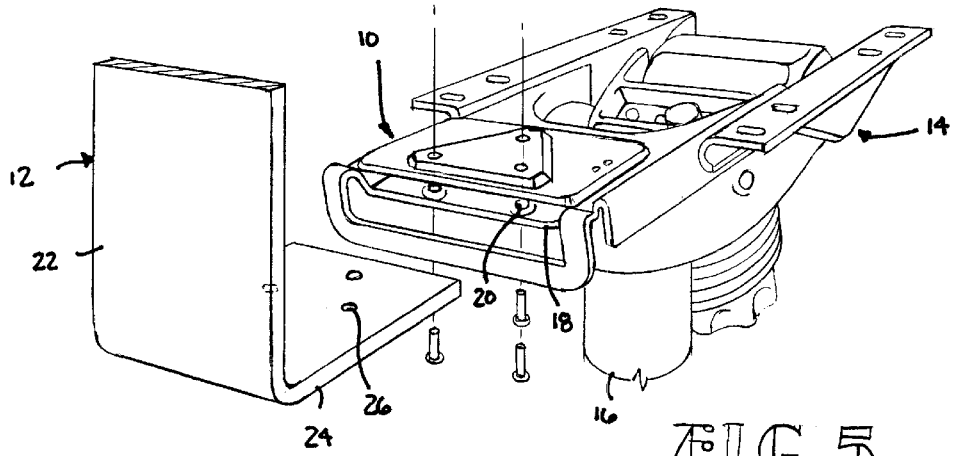
FIG. 1 is an exploded view of a partial J-back, tilt mechanism and nut plate retainer according to the principles of the present invention.

Referring initially to FIG. 1, a nut plate retainer according to the principles of the present invention is designated generally by the number 10. Retainer 10 is used to efficiently couple a J-back 12 to a tilt mechanism 14. Although not shown, a chair back can be coupled to the J-back 12 and a chair seat can be coupled to the tilt mechanism 14, as will be readily understood by those of skill in the art. The tilt mechanism 14 is also coupled to a support pedestal 16, shown partially in FIG. 1. Pedestal 16 supports the tilt mechanism, chair seat and chair back at a desired height above the floor.

As best seen in FIG. 1, the tilt mechanism 14 has a mounting area 18 that is used to mount the J-back 12 to the mechanism 14. Mounting area 18 has mounting holes 20 extending therethrough. Holes 20 are typically provided in an overall triangular pattern.

J-back 12 has a longer support 22 and a shorter support 24. Support 22 is coupled to the chair back and support 24 is coupled to the tilt mechanism 14. The overall shape and configuration of the J-back 12 can vary greatly depending upon the design of the chair. Importantly, support 24 has a pattern of mounting holes 26. As best seen in FIG. 1, holes 26 are located to align with holes 20 in tilt mechanism 14. In the prior art method, J-back 12 is bolted to tilt mechanism 14. This process can be cumbersome, as described above.

Figure 3:
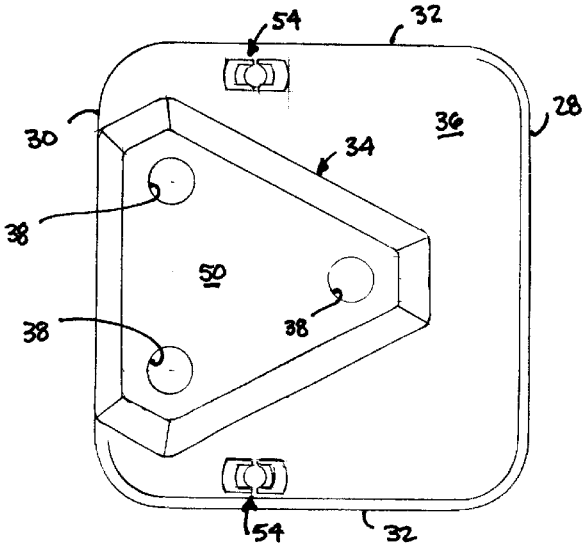
FIG. 3 is a top plan view of the nut plate retainer shown in FIG. 1.
Figure 4:
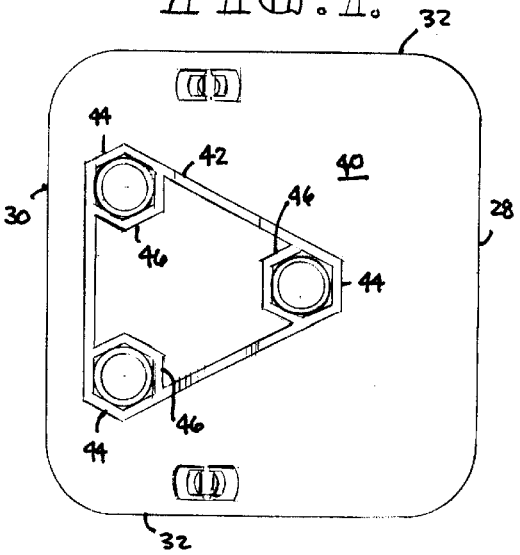
FIG. 4 is a bottom plan view of the nut plate retainer of FIG. 1.

The retainer 10 of the present invention. is used to make this process less cumbersome. As best seen in FIGS. 3 and 4, retainer 10 is configured with a generally rectangular shape, with a front edge 28, a back edge 30, and side edges 32. A raised triangular area 34 extends from a top surface 36 of the retainer 10. A number of holes 38 are provided that extend through the retainer. As shown in FIG. 3, holes 38 are arranged in a triangular pattern, with one hole 38 located in each corner of the raised triangular area 34. As described in more detail below, holes 38 are located to align with both holes 20 and 26.

Figure 2:
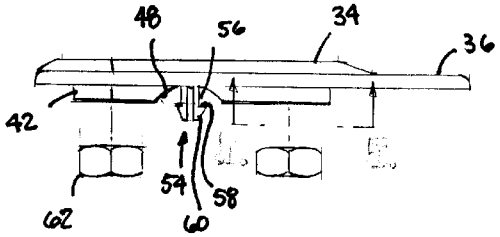
FIG. 2 is a side elevation view of the nut plate retainer shown in FIG. 1.

Turning to FIG. 4, a bottom surface 40 of retainer 10 is shown. As can be seen, holes 38 extend through retainer 10. As best seen in FIGS. 2 and 4, raised wall 42 extends upwardly from surface 40. Wall 42 is generally triangular in shape and is located to correspond with the raised triangular area 34. As best seen in FIG. 4, each corner of the triangular shape of wall 42 is truncated to present a flat wall portion 44. Wall portion 44 and the immediately adjacent portions of wall 42 form three sides of a six-sided, nut retaining wall 46. As best seen in FIG. 2, the portions of wall 42 extending from front edge 28 toward back edge 30 are formed with a curved depression 48. Depression 48 extends from the top of wall 42 to bottom surface 40.

Figure 5:
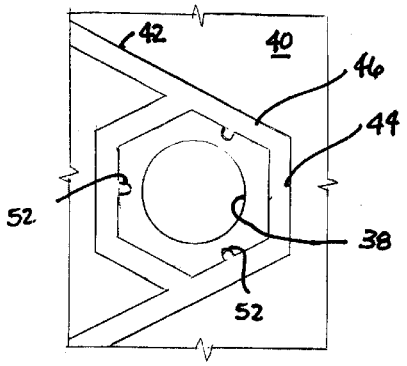
FIG. 5 is an enlarged view of a nut-retaining wall of the nut plate retainer of FIG. 1.

The interior portion of wall 42, along with the interior portion of wall 46, have a greater depth than the exterior of wall 42. This difference in depth creates a depressed surface 50 which corresponds to the raised area 34. Each of the nut retaining walls 46, on its interior side, extends to a depth corresponding to the depressed surface 50. Preferably, the depth corresponds to the height of the nuts that will be placed within walls 46, as more fully described below. As best seen in FIG. 5, an outwardly extending rib 52 is located generally midway along alternating sides of the hexagonal cavity formed by walls 46. In other words, every other side of the hexagon formed by walls 46 has a rib 52 extending therefrom.

As best seen in FIG. 2, retainer 10 has a pair of downwardly extending locking tabs 54 located adjacent each side edge 32. Each locking tab 54 has a pair of arms 56 that are spaced apart. Each arm 56 has an outwardly extending lip 58 and a tapered end portion 60. Locking tabs 54 are used to maintain retainer 10 in place adjacent the mounting area 18 of tilt mechanism 14. As can be understood, mounting area 18 has a pair of holes extending therethrough in a location corresponding to locking tabs 54. Extending lips 58 are located to correspond to the thickness of the material used in mounting area 18.

In use, retainer 10 is used to couple J-back 12 to tilt mechanism 14. In this process, nuts 62 are placed within each cavity formed by walls 46. The nuts are held in place by a friction-fit, which is enhanced by ribs 52. With the nuts held in place, the nut and retainer 10 assembly is placed on the mounting area 18 of tilt mechanism 14. In this location, locking tabs 54 will align with holes in the mounting area 18. The tapered portions 60 of the tabs 54 act as cams to guide arms 56 toward one another and into the holes. With retainer 10 fully in place, the lip 58 of each arm 56 will abut the interior surface of the wall of mounting area 18. It can, therefore, be understood that tabs 54 maintain retainer 10 in place on tilt mechanism 14. This maintains. the nuts in place between retainer 10 and tilt mechanism 14. This process can be completed by the manufacturer of the tilt mechanism, so that final assembly of the chair is simplified for the purchaser of the tilt mechanism.

Thereafter, to couple J-back 12 to tilt mechanism 14, the J-back 12 is located with holes 26 in alignment with the holes 38 in retainer 10. Once in this location, bolts are passed through holes 26 and 38 to engage the nuts held in place by retainer 10. As the bolts are tightened, the walls 46 prevent the nuts from moving, so that the nuts do not need to be separately held by the individual or machine coupling the J-back to the tilt mechanism. Preferably, retainer 10 is made from a plastic material that is molded in a one-piece unit.

It can therefore be seen that the present invention attains all of the objects set forth above. While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention. Accordingly, the scope of the present invention is defined by the appended claims rather than the foregoing description.

What is claimed is:

1. A retaining plate for use in the assembly of a chair to couple a J-back to a tilt mechanism, the J-back having a plurality of first mounting holes and the tilt mechanism having a plurality of second mounting holes aligned with the first mounting holes, the retaining plate comprising:

a plurality of third mounting holes defined in said plate, said third mounting holes located to align with said first and second mounting holes;

a nut-retaining wall formed around at least one of said third mounting holes, said nut-retaining wall being dimensioned to hold a threaded nut; and means for coupling said plate to said tilt mechanism, said coupling means including a pair of locking tabs extending generally perpendicular from said plate to engage said tilt mechanism, wherein at least one nut may be placed within and held by said nut-retaining wall, and wherein said plate may be coupled to said tilt mechanism so that the J-back may be coupled to the tilt mechanism by threading a bolt into the nut, the nut being held in place by said nut-retaining wall.

2. The retaining plate of claim 1, wherein a nut-retaining wall is formed around each of said third mounting holes.

3. The retaining plate of claim 2, wherein said nut-retaining walls form a hexagon.

4. The retaining plate of claim 3, wherein a portion of said nut-retaining wall has an outwardly extending rib, said rib adapted to frictionally hold the nut within the nut-retaining wall.

5. The retaining plate of claim 3, wherein said plate is molded in a one-piece unit.

6. A chair device comprising:

a J-back having a plurality of first mounting holes;

a tilt mechanism having a plurality of second mounting holes aligned with said first mounting holes; and a retaining plate comprising:

a plurality of third mounting holes defined in said plate, said third mounting holes located to align with said first and second mounting holes;

nut-retaining wall formed around at least one of said third mounting holes, said nut-retaining wall being dimensioned to hold a threaded nut; and means for coupling said plate to said tilt mechanism, wherein at least one nut may be placed within and held by said nut-retaining wall, and wherein said plate may be coupled to said tilt mechanism so that said J-back may be coupled to said tilt mechanism by threading a bolt into said nut, said nut being held in place by said nut-retaining wall.

7. The chair device of claim 6, wherein said third mounting holes are arranged in a triangular configuration.

8. The chair device of claim 6, wherein a nut-retaining wall is formed around each of said third mounting holes.

9. The chair device of claim 8, wherein said nut-retaining walls form a hexagon.

10. The chair device of claim 9, wherein a portion of said nut-retaining wall has an outwardly extending rib, said rib adapted to frictionally hold the nut within said nut-retaining wall.

11. The chair device of claim 9, wherein said coupling means includes a pair of locking tabs adapted to engage said tilt mechanism.

12. The chair device of claim 9, wherein said plate is molded in a one-piece unit.

* * * * *